US005753854A

United States Patent [19]

Richards et al.

[11] Patent Number: 5,753,854

[45] Date of Patent: May 19, 1998

[54] FIRE-PROOF BLANKET FOR PROTECTION OF ELECTRICAL CABLE SPLICES HAVING EMBEDDED SNAP

[75] Inventors: William J. Richards, Rockland; Sherman T. Whipple, Plymouth, both of Mass.

[73] Assignee: Polytrap Co. Inc., Rockland, Mass.

[21] Appl. No.: 690,490

[22] Filed: Jul. 31, 1996

[51] Int. Cl.[6] ..... H01B 3/00

[52] U.S. Cl. ..... 174/5 R; 174/93

[58] Field of Search ..... 174/5 R, 55 B, 174/93; 5/483; 63/3, 11

[56] References Cited

U.S. PATENT DOCUMENTS

| | | | |
|---|---|---|---|
| 1,224,970 | 5/1917 | Singer | 174/5 R |
| 2,229,849 | 1/1941 | Heidebrecht | 174/84 R |
| 3,410,023 | 11/1968 | Anello | 446/353 |
| 5,038,693 | 8/1991 | Kourtides et al. | 112/440 |
| 5,277,959 | 1/1994 | Kourtides et al. | 428/116 |
| 5,310,594 | 5/1994 | Holland et al. | 428/167 |

FOREIGN PATENT DOCUMENTS

| | | | |
|---|---|---|---|
| 406410 | 3/1934 | United Kingdom | 174/5 R |

*Primary Examiner*—Kristine L. Kincaid
*Assistant Examiner*—Kamand Cuneo
*Attorney, Agent, or Firm*—Bromberg & Sunstein LLP

[57] ABSTRACT

A device and method are provided for installing fire-proof material quickly and easily. The fire-proof material, once installed, inhibits the spread of igniting material across an annular space surrounding an object. A device according to the invention includes a blanket made of a fire-resistant material. In a preferred embodiment, this material is silica fabric. A plurality of ribs are attached at spaced-apart locations along the length of the blanket, each rib extending substantially the width of the blanket. Each rib, in a first condition, permits one side of the blanket to be brought into contact with the object, and in a second condition, holds the blanket in place around the object. The ribs are preferably snap strips that have two stable orientations: an extended stable orientation, which corresponds to the first condition, and a curled stable orientation, which corresponds to the second condition. When the blanket is bent along its length while the snap strips are in their extended stable orientation, the snap strips tend to assume the curled stable orientation. The snap strips are preferably formed from metal on which two opposing stresses are imparted. One stress causes the snap strip to curl along its length and causes the blanket to wrap around the object (e.g., the cable splice) being covered by the blanket. The other stress causes the snap strip to have a cupped cross-section while in the extended orientation. This cupped cross-section curves in a direction opposed to the curling and thus towards the side of the blanket away from the object. In a preferred embodiment, the fire-proof material may also be easily removed.

5 Claims, 4 Drawing Sheets

FIRE-PROOF BLANKET FOR PROTECTION OF ELECTRICAL CABLE SPLICES HAVING EMBEDDED SNAP

TECHNICAL FIELD

The present invention generally relates to devices for installing fire-proofing material, and in particular to devices for installing fire-proofing material around a cable.

BACKGROUND ART

When a cable fails, sparks emanating from the cable frequently damage nearby cables. Cable failures usually take place at the site of a splice. The materials presently used in covering a splice are often inadequate for containing sparks that emanate from a cable or cable splice that fails, and these materials are subject to melting, burning and emitting noxious gasses.

The present installation methods are time consuming and often difficult. Presently, after a cable is spliced, the worker must wait (often for more than thirty minutes) for the splice to cool off before covering the splice, since the covering material may melt when it comes into contact with a hot splice. The covering material is supplied as rolls of tape, so that, after the splice cools off, the covering material is usually rolled onto the cable splice. Under the best of circumstances, rolling the tape around the cable splice is difficult and time consuming; in the close quarters of a manhole, where cable splices are typically located, rolling tape around a splice is sometimes impossible to do properly. Once the tape is installed, the splice cannot be easily inspected.

SUMMARY OF THE INVENTION

The invention provides a device and method for installing fire-proof material quickly and easily. In a preferred embodiment, the fire-proof material may be easily removed. The fire-proof material, once installed, inhibits the spread of igniting material across an annular space surrounding an object. Thus, the present invention greatly reduces the likelihood of a fire being caused by an object such as a cable splice.

A device according to the invention includes a blanket made of a fire-resistant material. In a preferred embodiment, this material is silica fabric. A plurality of ribs are attached at spaced-apart locations along the length of the blanket, each rib extending substantially the width of the blanket. Each rib, in a first condition, permits one side of the blanket to be brought into contact with the object, and in a second condition, holds the blanket in place around the object.

The ribs are preferably snap strips that have two stable orientations: an extended stable orientation, which corresponds to the first condition, and a curled stable orientation, which corresponds to the second condition. When the blanket is bent along its length while the snap strips are in their extended stable orientation, the snap strips tend to assume the curled stable orientation.

The snap strips are preferably formed from metal on which two opposing stresses are imparted. One stress causes the snap strip to curl along its length and causes the blanket to wrap around the object (e.g., the cable splice) being covered by the blanket. The other stress causes the snap strip to have a cupped cross-section while in the extended orientation. This cupped cross-section curves in a direction opposed to the curling and thus towards the side of the blanket away from the object.

To install the device using snap strips around a cylindrical object, the blanket with the snap strips in the extended orientation is preferably oriented with respect to the cylindrical object such that cross-sections of the snap strips curve away from the cylindrical object, and such that the snap strips are oriented transversely to the cylindrical object's axis. The cylindrical object is then struck with the blanket, such that the snap strips assume the curled orientation and wrap the blanket around the cylindrical object.

BRIEF DESCRIPTION OF THE DRAWINGS

FIG. 5A shows a typical lead splice.

DETAILED DESCRIPTION OF SPECIFIC EMBODIMENTS

Figure 1:
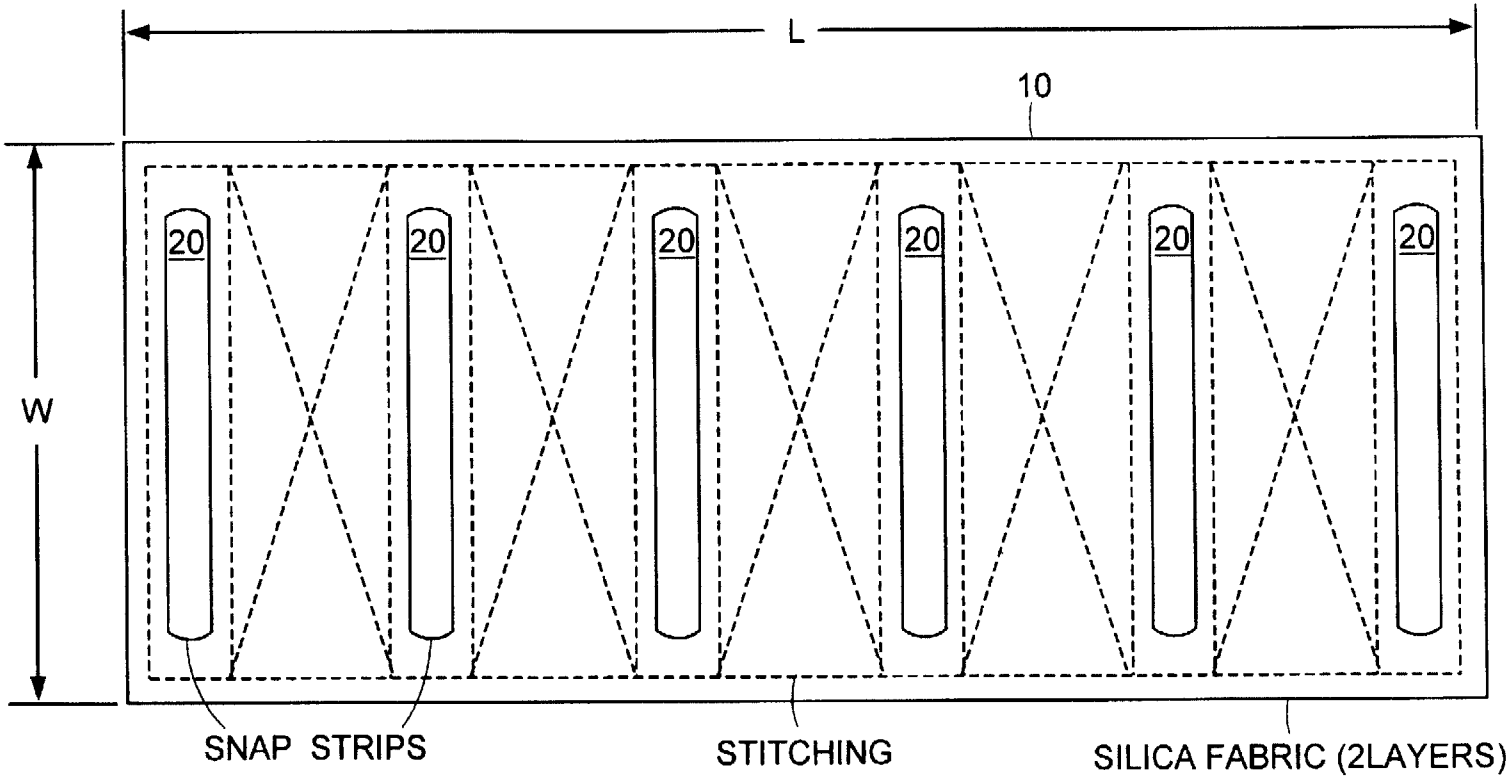
FIG. 1 is a top view of an fire-proof blanket according to the present invention.
Figure 2:
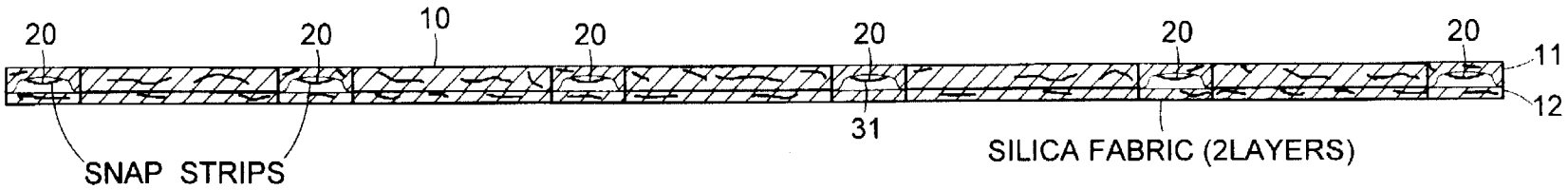
FIG. 2 is a side view of the blanket of FIG. 1.

As can be seen in FIGS. 1 and 2, a device made according to a preferred embodiment of the present invention includes a blanket 10 with ribs 20 located at spaced-apart locations. The blanket 10 has a length, L, and a width, W. The ribs 20 are sewn into the blanket and extend across the blanket's width. The blanket 10 is made of a fabric that resists arcing and fire, such as silica fabric. A vermiculite-coated silica fabric made by Amatex Corporation of Norristown, Pa. (model # HTX-600-9N) has been found to be a suitable material for the blanket. This vermiculite-coated silica fabric is able to tolerate of 1800° F. continuous and has melt temperature of 3000° F. The blanket 10 in a preferred embodiment is made of a first layer 11 of silica fabric and a second layer 12 of silica fabric with the ribs 20 sewn between the two layers. A preferred stitching pattern is shown as dashed lines in FIG. 1.

Figure 3:
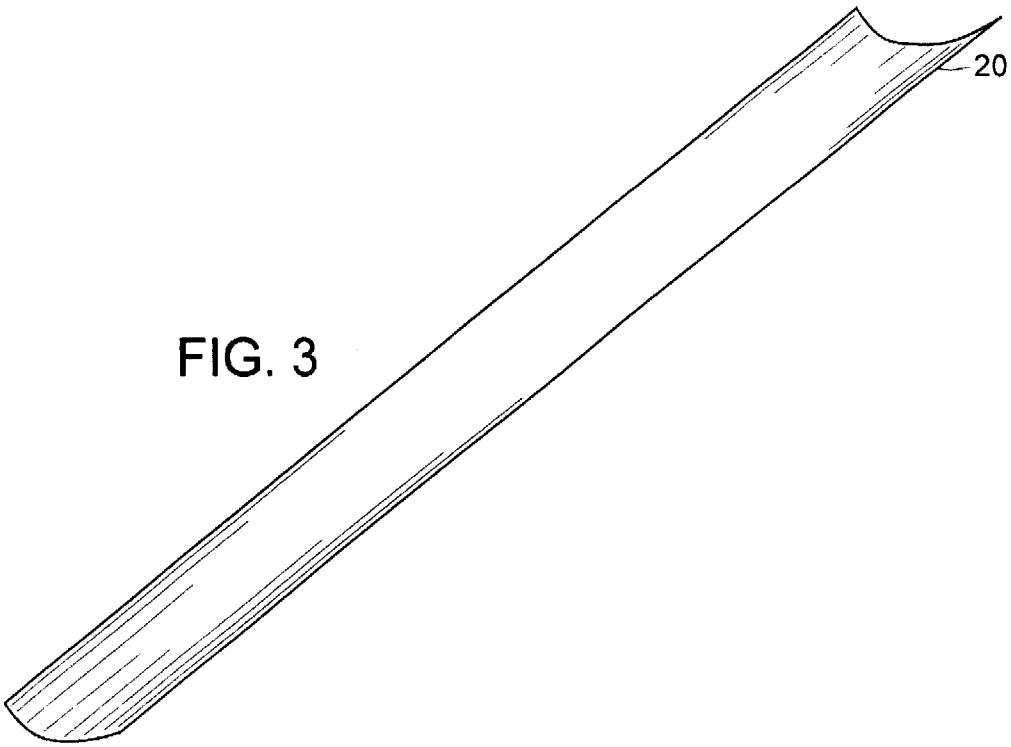
FIG. 3 is a perspective view of a snap strip in an extended orientation.
Figure 4:
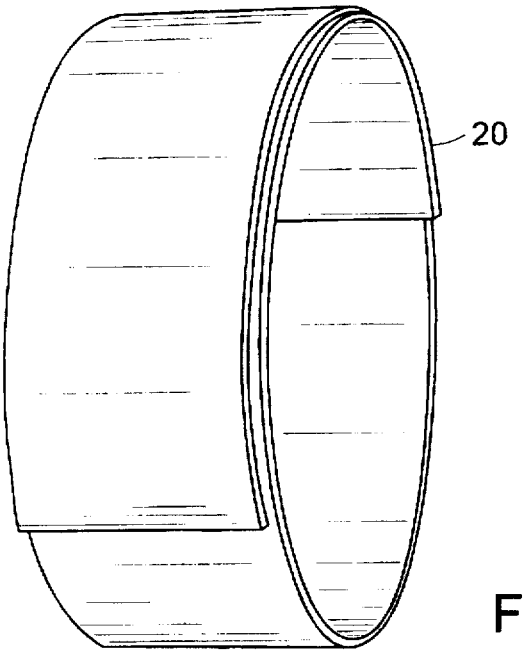
FIG. 4 is a perspective view of a snap strip in a curled orientation.

The ribs 20 are preferably snap strips, such as the snap strip shown in FIGS. 3 and 4. The snap strips have two stable orientations: an extended stable orientation, which is shown in FIG. 3, and a curled stable orientation, which is shown in FIG. 4.

These snap strips are preferably constant-force springs with opposing stresses, such as the snap-tape springs made by Vulcan Spring & Mfg. Co. of Telford, Pa. A preferred embodiment of these snap-tape springs are one-inch wide and 0.060 inches thick. The snap-tape springs are made using a cold-rolling process that imparts a stress, or memory, on the spring. This stress causes the spring to roll up into a cylinder. The springs are then put through a special die to form an opposing stress that causes a cupped cross-section across the one-inch width of the spring. The profile is engineered to oppose the tendency of the spring to curl up into a cylinder. The ratio of the stresses used to manufacture the snap-tape springs preferably slightly favors the tendency for the spring to remain in the extended configuration. The spring manufactured in this manner will remain extended until it is bent across its width. This bending assists the spring's tendency to curl up. When in the curled state, the cupped cross section flattens out. The tendency to return to the cupped state remains, however. Once the snap-tape spring is in the curled state, it will remain so until it is physically straightened out, allowing the cup to return. In either state, some external force must be applied to the spring to change the configuration.

Figure 5B:
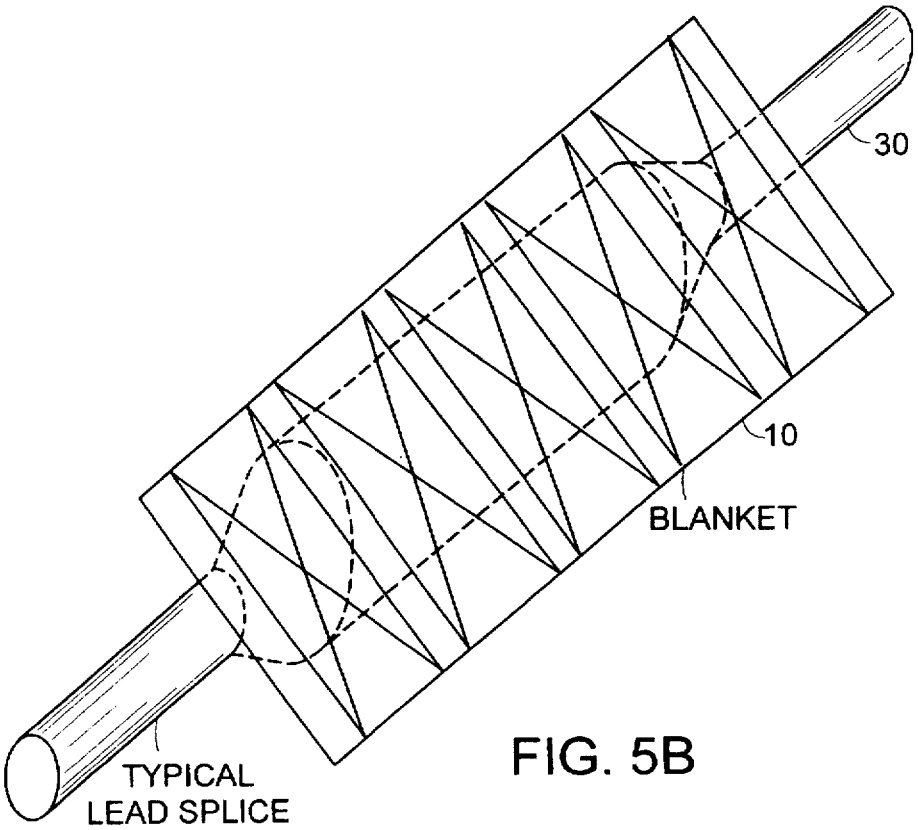
FIG. 5B is a perspective view of an fire-proof blanket being oriented with respect to a lead splice in order to be installed around the lead splice.
Figure 6:
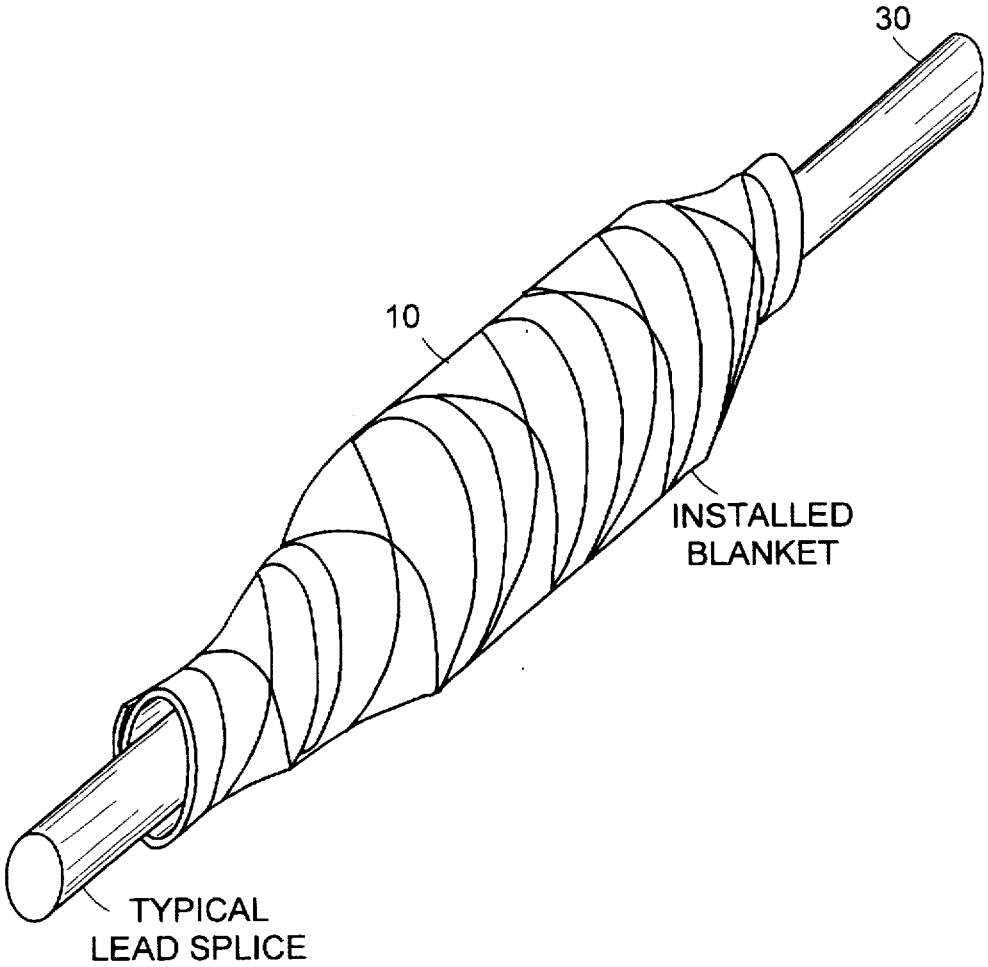
FIG. 6 is a perspective view of the fire-proof blanket installed on a cable splice.

The snap strips 20 used in the preferred embodiment of the invention act as clamps that hold the blanket 10 on the object to be covered. To install the device using snap strips around a cable 30, the blanket 10 is flattened out so that the snap strips 20 are in the extended orientation. (See FIGS. 5A and 5B.) The blanket 10 is then oriented so that its length is aligned with the cable. The snap strips 20 are thus oriented transversely to the cable. The blanket's orientation should also be such that cross-sections of the snap strips 20 curve away from the cable 30. Thus, the snap strip's convex side 31 (see FIG. 2) is adjacent the cable. The cable 30 is then struck with the blanket 10, such that the snap strips 20 assume the curled orientation and wrap the blanket 10 around the cable 30. (See FIG. 6.) The bending of the blanket along its length causes the snap strips to assume the curled orientation. The snap strips 20 in the curled orientation hold the blanket 10 around the cable 30.

It will be appreciated that the design of the device shown in the figures permits the very quick and simple installation of fire-proofing material around the cable. Unlike using rolled tape of the prior art, the present design allows the blanket to be installed with minimal disturbance to the cable and without requiring as much work area. Also, the preferred blanket material permits the blanket to be installed without waiting for the splice to cool off. In addition to cutting labor costs, the present invention reduces the risk of injury to the worker installing or removing the product from energized cables.

This design also permits the blanket to be quickly removed from the cable, thereby allowing for the splice to be inspected easily. After an inspection, the same blanket may be re-installed over the splice. The design also permits the device to be shipped in the flat state.

In a less preferred embodiment of the invention, another type of rib, instead of using snap strips, may be used that would permit the blanket to easily installed and hold the blanket securely in place around a cable splice. For example, such ribs may use epoxy-like compositions that allow the blanket to wrap easily around the cable, but harden after the blanket is installed. Such an embodiment would of course be more difficult to remove than the preferred snap-spring embodiment and would not be reusable like the snap-spring embodiment. It will be further appreciated that the snap-strip embodiment is easier and less expensive to manufacture and generally much easier to use than an embodiment using epoxy-like compositions.

Although the invention has been described with reference to several preferred embodiments, it will be understood by one of ordinary skill in the art that various modifications can be made without departing from the spirit and the scope of the invention, as set forth in the claims hereinbelow.

I claim:

1. A device for inhibiting the spread of igniting material across an annular space surrounding an object, the device comprising:

a blanket made of a fire-resistant material, the blanket having a length and a width, and first and second sides; and a plurality of ribs attached at spaced-apart locations along the length of the blanket, each of said plurality of ribs extending substantially the width of the blanket, wherein each of said plurality of ribs, in a first condition, permits the first side of the blanket to be brought into contact with the object, and in a second condition, holds the blanket in place around the object;

wherein the plurality of ribs includes a plurality of snap strips, wherein each of said plurality of snap strips has two stable orientations, an extended stable orientation, which corresponds to the first condition, and a curled stable orientation, which corresponds to the second condition, such that, when the blanket is bent in a direction perpendicular to its width while the snap strips are in the extended stable orientation, the snap strips assume the curled stable orientation; and wherein each of said plurality of snap strips is formed from metal on which two opposing stresses are imparted, so that, while in the extended orientation, said each of said snaps has a cupped cross-section that curves in a direction towards the blanket's second side.

2. A device according to claim 1, wherein the blanket is made of silica fabric.

3. A device for inhibiting the spread of igniting material across an annular space surrounding an object, the device comprising:

a blanket made of a fire-resistant material, the blanket having a length and a width: and a plurality of snap strips attached at spaced-apart locations along the length of the blanket, each of said plurality of snap strips extending substantially the width of the blanket, wherein each of said plurality of snap strips has two stable orientations, an extended stable orientation and a curled stable orientation, such that, when the blanket is bent in a direction perpendicular to its width while the snap strips are in the extended stable orientation, the snap strips assume the curled stable orientation;

wherein the blanket is made of silica fabric; and wherein each of said plurality of snap strips is formed from metal on which two opposing stresses are imparted, so that, while in the extended orientation, said each of said plurality of snap strips has a cupped cross-section that curves in a direction opposite the curled stable orientation.

4. A device for inhibiting the spread of igniting material across an annular space surrounding an object, the device comprising:

a blanket made of a fire-resistant material, the blanket having a length and a width; and a plurality of snap strips attached at spaced-apart locations along the length of the blanket, each of said plurality of snap strips extending substantially the width of the blanket;

wherein each of said plurality of snap strips has two stable orientations, an extended stable orientation and a curled stable orientation, such that, when the blanket is bent in a direction perpendicular to its width while the snap strips are in the extended stable orientation, the snap strips assume the curled stable orientation; and wherein each of said plurality of snap strips is formed from metal on which two opposing stresses are imparted, so that, while in the extended orientation, said each of said plurality of snap strips has a cupped cross-section that curves in a direction opposite the curled stable orientation.

5. A device according to claim 1, wherein the method of installing the device about a cylindrical object, the cylindrical object having an axis, comprises the steps of:

orienting the blanket with respect to the cylindrical object, while the snap strips are in the extended orientation, such that the snap strips curve away from the cylindrical object, and such that the snap strips are oriented transversely to the cylindrical object's longitudinal axis; and wrapping the blanket around the cylindrical object, such that the snap strips assume the curled orientation and wrap the blanket around the cylindrical object.

* * * * *